US007464975B1

(12) United States Patent
Cox

(10) Patent No.: US 7,464,975 B1
(45) Date of Patent: Dec. 16, 2008

(54) APPARATUS FOR HOLDING AND TRANSPORTING MULTIPLE BOOKS

(76) Inventor: Philip Cox, 4131 Bayou Black Dr., Houma, LA (US) 70360

( * ) Notice: Subject to any disclaimer, the term of this patent is extended or adjusted under 35 U.S.C. 154(b) by 456 days.

(21) Appl. No.: 11/176,973

(22) Filed: Jul. 7, 2005

Related U.S. Application Data

(60) Provisional application No. 60/586,003, filed on Jul. 7, 2004.

(51) Int. Cl.
*A45F 5/12* (2006.01)

(52) U.S. Cl. ..... 294/138; 294/146; 294/149; 294/165

(58) Field of Classification Search ..... 294/138, 294/146, 149, 150, 151, 165; 281/31, 35; 224/601, 602; 206/472–475
See application file for complete search history.

(56) References Cited

U.S. PATENT DOCUMENTS

| | | | | | |
|---|---|---|---|---|---|
| 738,462 | A | | 9/1903 | Lincoln | |
| 1,082,017 | A | * | 12/1913 | Feinen | 294/149 |
| 1,109,846 | A | * | 9/1914 | Knap | 294/138 |
| 1,689,416 | A | * | 10/1928 | Wood | 190/109 |
| 2,422,235 | A | * | 6/1947 | Greene | 294/138 |
| 2,532,306 | A | * | 12/1950 | Herbert | 294/150 |
| 3,623,526 | A | | 11/1971 | Robertson | |
| 3,683,987 | A | | 8/1972 | Robertson | |
| 4,562,952 | A | | 1/1986 | Chinman | |
| D289,288 | S | | 4/1987 | Muenscher et al. | |
| 4,684,163 | A | | 8/1987 | Anderson | |
| 4,881,684 | A | | 11/1989 | Chinman | |
| 4,958,759 | A | * | 9/1990 | Jarvis | 224/153 |
| 5,251,945 | A | * | 10/1993 | Stoops | 294/152 |
| 5,348,347 | A | | 9/1994 | Shink | |
| 5,494,366 | A | * | 2/1996 | Pell et al. | 402/73 |
| 6,241,414 | B1 | * | 6/2001 | Wien | 402/73 |
| 6,457,635 | B1 | * | 10/2002 | Scicluna | 229/87.17 |

* cited by examiner

*Primary Examiner*—Dean J Kramer
(74) *Attorney, Agent, or Firm*—Garvey, Smith, Nehrbass & North, L.L.C.; Seth M. Nehrbass; Charles C. Garvey, Jr.

(57) ABSTRACT

An improved book holding device is disclosed that enables a user to carry a plurality of books as well as related articles such as electronic devices, calculators, cell phones, electronic organizers, PDAs, digital music players and the like. The apparatus features an "x" shaped sheeted material having elongated straps. One of the straps carries a larger pouch that has a length that is about equal to or greater than the half of the length of its strap. Smaller pouches can be provided for holding smaller articles.

11 Claims, 2 Drawing Sheets

APPARATUS FOR HOLDING AND TRANSPORTING MULTIPLE BOOKS

CROSS-REFERENCE TO RELATED APPLICATIONS

Priority of U.S. Provisional Patent Application Ser. No. 60/586,003, filed Jul. 7, 2004, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an apparatus for holding and carrying multiple books and other articles (e.g. electronic devices). More particularly, the present invention relates to an improved book holding apparatus having a pouch that extends along the length of one strap of the device for holding a selected article such as a calculator, cell phone, personal organizer, digital music player or the like.

2. General Background of the Invention

Students are typically required to carry a plurality of books when attending classes. Students also must carry associated products such as ink pens, pencils, calculators and the like.

Certain electronic devices (e.g. mobile telephone, portable music player, personal digital assistant or like organizer) can be far more valuable than the books and must necessarily be carried in a manner that secures them but also enables the owner to view the electronic device and protect it from inadvertent loss.

The following U.S. patents disclose book carriers and are each hereby incorporated herein by reference.

U.S. Pat. No. 738,462 discloses a strap package for school books, pencils, and a ruler.

U.S. Pat. No. 3,623,536 discloses a four point knockdown folding package with Velcro on two of the folding arms. It is to be used with school books.

U.S. Pat. No. 4,684,163 discloses a mail holder made from a single holder with four arms and having Velcro on two of the arms.

U.S. Pat. Nos. 3,683,987 and 4,881,784 each disclose holders with four arms that have Velcro on multiple arms for securing books.

U.S. Pat. No. 5,348,347 discloses a Velcro strap holder for a cell phone and related items.

BRIEF SUMMARY OF THE INVENTION

The apparatus of the present invention is an improved device for holding books. The device is configured to hold books and an electronic device such as a calculator, digital music player, mobile telephone or a personal digital assistant ("PDA"). A zippered larger compartment can hold various items. In each case, hook and loop fasteners can be used to adjust the size of the straps and secure them to one another.

The present invention provides an improved book holder apparatus that employs a generally x-shaped sheet like material having upper and lower surfaces.

A central portion of the x-shaped structure communicates with four straps that extend radially from the central portion along respective generally perpendicular axes. Each strap provides a strap end portion and has a width and a length. The upper surface of the sheet of material defines a surface for holding one or more books. The upper surface includes connecting portions on the straps that enable the straps to be connected together. A first pair of the straps connect together along a first of said axes and the other pair of straps connect along a second of the axes.

A storage pouch is mounted on one of the straps next to a strap end and extends along the strap a distance of about one half the length of the strap. The storage pouch has a width that approaches the width of the strap to which it is attached.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
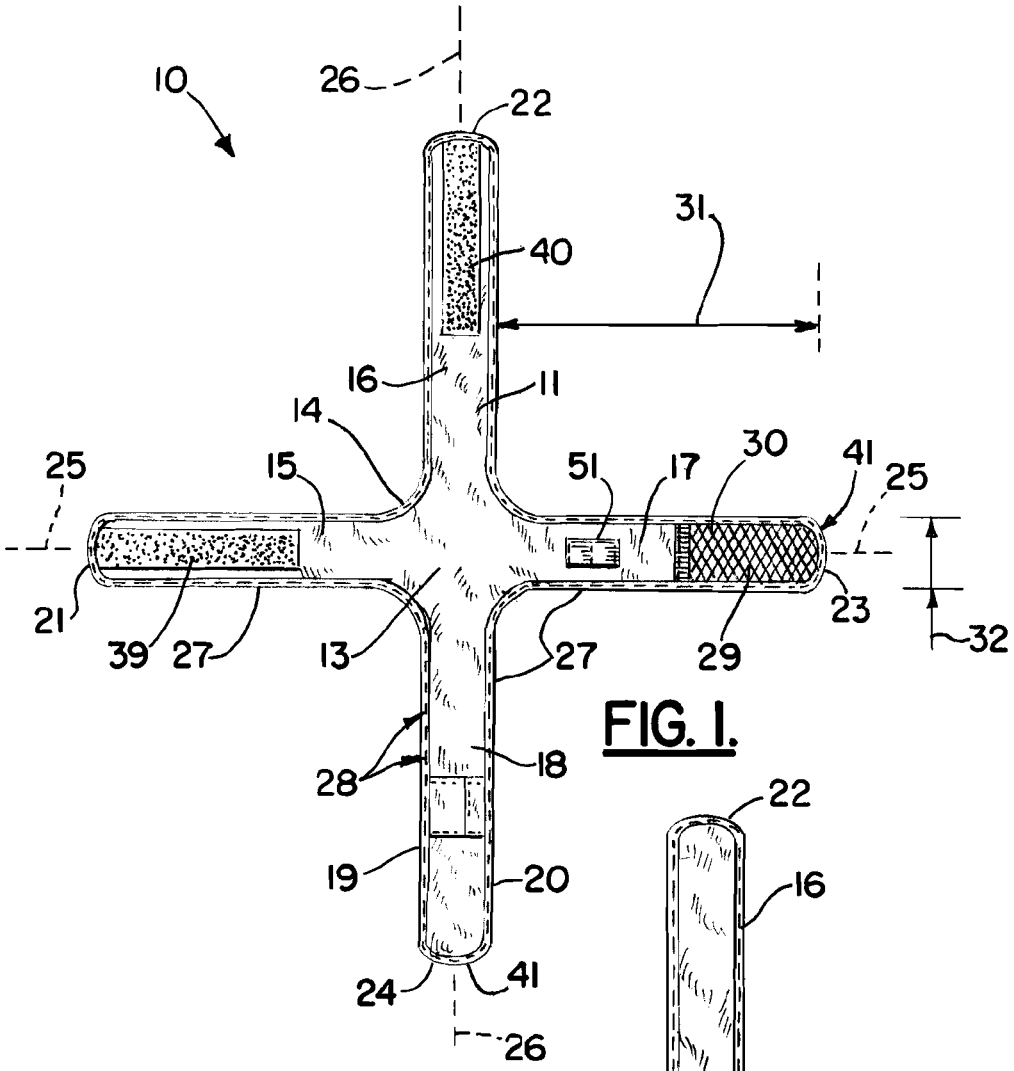
FIG. 1 is a top view of a first, preferred embodiment of the apparatus of the present invention.
Figure 2:
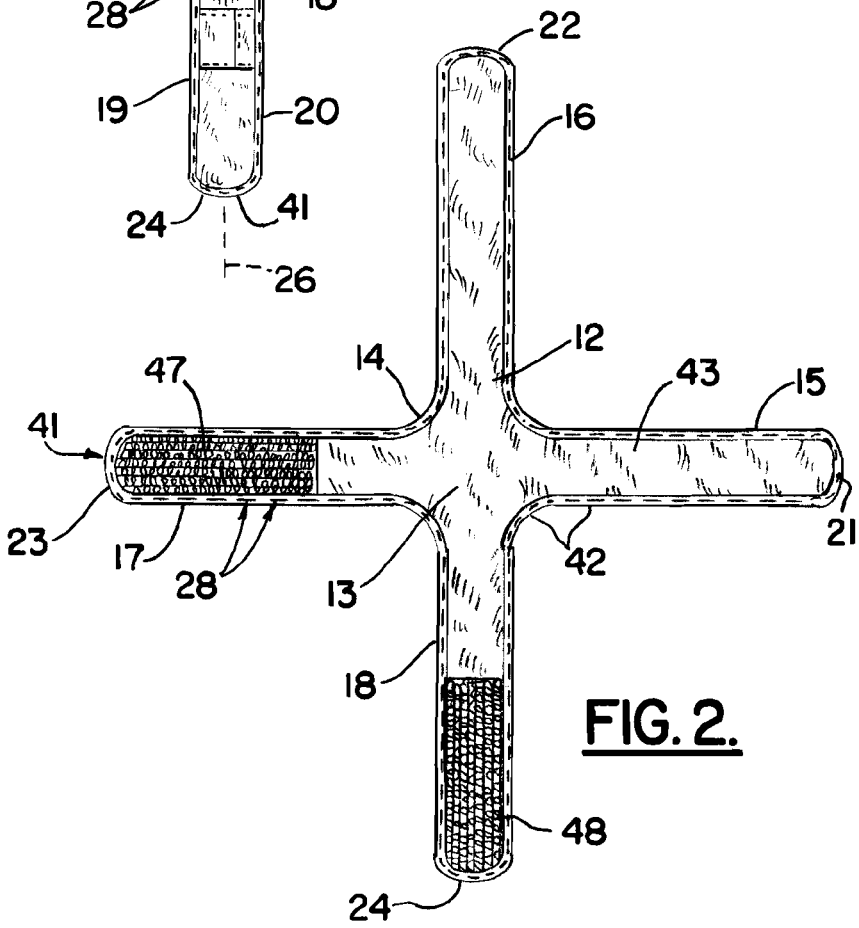
FIG. 2 is a bottom view of the preferred embodiment of the apparatus of the present invention.
Figure 3:
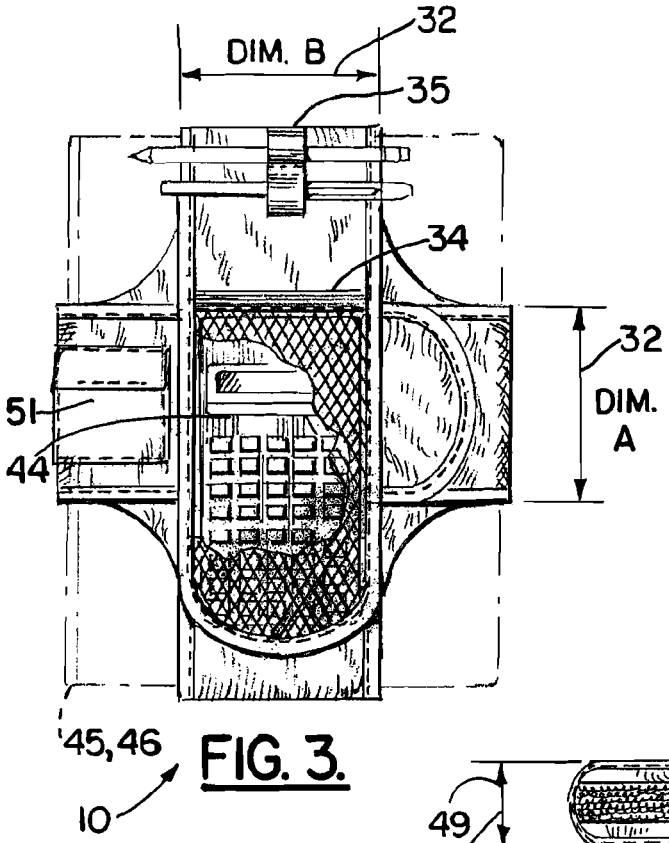
FIG. 3 is a top view of the preferred embodiment of the apparatus of the present invention showing folded, book carrying position.
Figure 4:
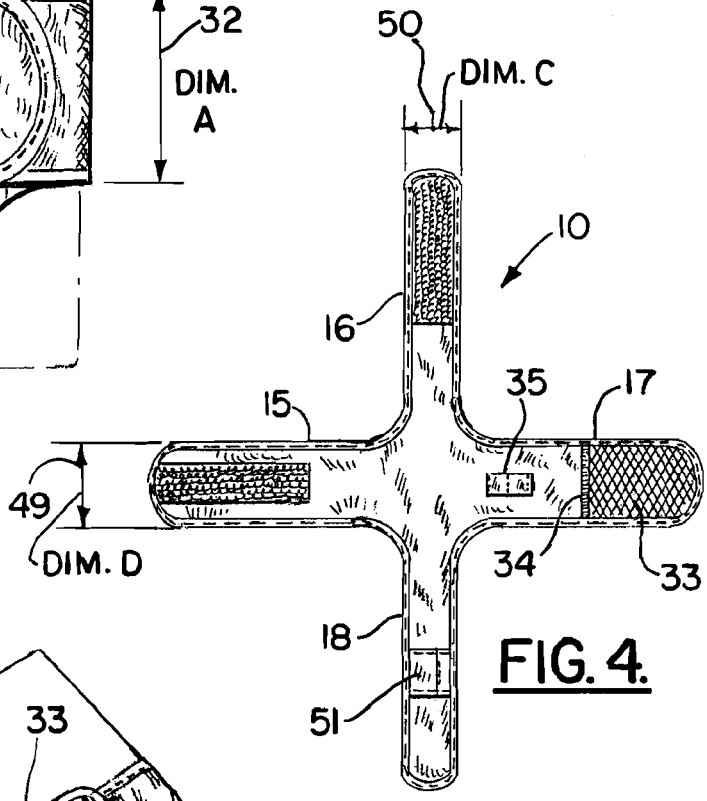
FIG. 4 is a top view of a second embodiment of the apparatus of the present invention shown in folded position.

FIGS. 1-5 show book strap apparatus 10 that can be made of a single sheet of material that is basically "X" shaped as shown in FIGS. 1-2 and 4, having upper surface 11 and lower surface 12. The sheet of material is comprised of central portion 13 and a plurality of straps 15, 16, 17, 18 that extend radially from central portion 13. Curved edges 14 of the central portion form an interface between the central portion and the straps 15-18.

Each strap 15-18 has opposing, preferably generally parallel edges 19, 20. Each strap 15-18 also has a free end portion. The strap 15 provides free end portion 21. Strap 16 provides free end portion 22. In like manner, the straps 17, 18 provide respective free end portions 23, 24.

Two of the straps 15 and 17 connect along a first axis 25. The other two straps 16 and 18 connect along a second axis 26. Fasteners 39, 40 can be used to secure the straps together as shown in the drawings. In the preferred embodiment, one fastener part is a fastener part 39 on strap 15. A fastener part 40 is provided on a strap 17. Straps 15 and 16 have fastener parts 39, 40 respectively. Straps 17 and 18 have fastener parts 47, 48 respectively. Fasteners 39, 40 can be loop style fasteners. Fasteners 47, 48 can be hook type fasteners (e.g. Velcro®). A periphery of the apparatus 10 is defined by the curved edges 14 of central portion 13, the opposed edges 19, 20 and a curved part 41 of each strap free end 21, 22, 23, 24.

This periphery 42 of sheeted material 43 can be provided with piping 27 attached thereto using stitching 28.

In the preferred embodiment, the piping 27 and stitching 28 is used to secure storage pouch 29 to upper surface 11 and to opposed edges 19, 20 at a position next to curved end 41 of a selected one of the straps. The same piping 27 and stitching 28 can simultaneously secure fastener part 47 and the storage pouch 29. The storage pouch 29 can provide a see-through panel 30 or mesh material, for example. The storage pouch 29 is selectively placed on a single one of the straps 15, 16, 17 or 18, such as strap 17 in FIGS. 1-2 and 5. The selected strap 17 has a strap length 31 and a strap width 32. The storage pouch 29 can have a width that is about equal to the strap width 32 and can have a length that is about equal to one half or less of the strap length 31. For example, the strap length can be between about 14 and 17 inches long. The strap width can be between about 2 and 4 inches wide. The storage pouches 33 each preferably have a length of between about 5 and 7 inches and a width of between about 2 and 4 inches. A larger pouch 33 is shown in FIGS. 3 and 5.

Figure 5:
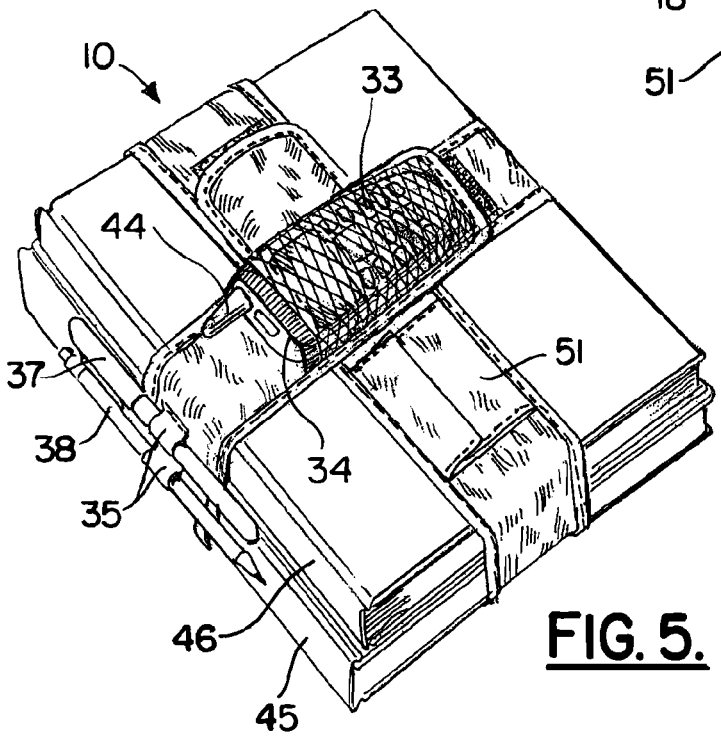
FIG. 5 is a perspective view of the preferred embodiment of the apparatus of the present invention.

Storage loops 35 can be provided as shown in FIGS. 3 and 5 having openings that are receptive of articles such as ink pen 37 and pencil 38. The storage pouch 33 has a pouch opening 34 that can be about equal to strap width 32. Books 45, 46 can be stored within closed straps 15-18 of device 10, as seen in FIGS. 3 and 5. An electronic device 44 such as a mobile telephone, calculator, personal digital assistant, or digital music player can be stored in pouch 29 or 33. Pouch 29 is used for smaller electronic devices such as a mobile telephone or digital music player. Larger pouch 33 can be used to hold larger devices 44 such as a calculator.

In FIG. 4, it is illustrated that the straps 15, 17 can be of a larger dimension, shown as strap width 49, while straps 16, 18 can have a smaller strap width 50. A pouch 51 for coins, etc can be mounted on upper surface 11 as seen in FIGS. 1, 3, 4 and 5.

PARTS LIST

The following is a list of parts and materials suitable for use in the present invention:

| Parts Number | Description |
|---|---|
| 10 | book strap apparatus |
| 11 | upper surface |
| 12 | lower surface |
| 13 | central portion |
| 14 | curved edge |
| 15 | strap |
| 16 | strap |
| 17 | strap |
| 18 | strap |
| 19 | edge |
| 20 | edge |
| 21 | free end portion |
| 22 | free end portion |
| 23 | free end portion |
| 24 | free end portion |
| 25 | axis |
| 26 | axis |
| 27 | piping |
| 28 | stitching |
| 29 | larger storage pouch |
| 30 | see through panel |
| 31 | strap length |
| 32 | strap width |
| 33 | storage pouch |
| 34 | larger pouch opening |
| 35 | storage loop |
| 36 | electronic device |
| 37 | ink pen |
| 38 | pencil |
| 39 | fastener part |
| 40 | fastener part |
| 41 | curved end |
| 42 | periphery |
| 43 | sheet of material |
| 44 | electronic device |
| 45 | book |
| 46 | book |
| 47 | fastener part |
| 48 | fastener part |

-continued

| Parts Number | Description |
|---|---|
| 49 | strap width |
| 50 | strap width |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A book strap apparatus, comprising:

a) an X shaped sheet of material having upper and lower surfaces, a central portion that includes four curved edges, and four straps that extend radially from the central portion along respective generally perpendicular axes, each strap having a strap free end, a strap free end portion, a width, and a length defined by the distance between the respective strap free end and a curved edge of the central portion;

b) the upper surface of the sheet of material defining a surface for holding one or more books, the upper surface including connecting portions on the straps that enable the straps to be connected together wherein a first pair of the straps connect together along a first of said axes and the other pair of the straps connect together along a second of said axes; and c) a storage pouch mounted on one of the straps next to a strap end and extending along the strap more than half the length of the strap, the storage pouch having a width that approaches the width of the strap to which it is attached.

2. The book holder apparatus of claim 1 wherein the storage pouch has a see-through panel that enables a user to view the contents of the pouch.

3. The book holder apparatus of claim 1 wherein the storage pouch has a mesh panel.

4. The book holder apparatus of claim 1 wherein the storage pouch extends to the free end portion of a strap.

5. The book holder apparatus of claim 1 wherein there are a plurality of storage pouches mounted to one or more of the strap.

6. The book holder apparatus of claim 5 wherein one of the storage pouches is much larger than other of the storage pouches.

7. The book holder apparatus of claim 6 wherein the storage pouches are mounted on the same strap.

8. The book holder apparatus of claim 6 wherein the smaller storage pouch is mounted in between the larger storage pouch and the central portion.

9. The book holder apparatus of claim 1, further comprising piping along strap edge portions that is secured to the strap edges with stitching and wherein the piping and stitching secure the pouch to the strap.

10. The book holder apparatus of claim 9 wherein the piping connects to the storage pouch at the free end portion of one of the straps.

11. The book holder apparatus of claim 1 wherein stitching connects to the storage pouch to the free end portion of one of the straps.

* * * * *